US008056169B2

(12) United States Patent
McManamy et al.

(10) Patent No.: US 8,056,169 B2
(45) Date of Patent: Nov. 15, 2011

(54) INSTITUTIONAL MATTRESS AND PILLOW COMPOSITE WITH TRANSPARENT COVERING

(75) Inventors: John Joseph McManamy, Latrobe, PA (US); Carl Melvin Ogburn, Pittsburgh, PA (US)

(73) Assignee: Chestnut Ridge Foam, Inc., Latrobe, PA (US)

( * ) Notice: Subject to any disclaimer, the term of this patent is extended or adjusted under 35 U.S.C. 154(b) by 913 days.

(21) Appl. No.: 11/221,338

(22) Filed: Sep. 7, 2005

(65) Prior Publication Data

US 2006/0075566 A1 Apr. 13, 2006

Related U.S. Application Data

(63) Continuation-in-part of application No. 10/964,483, filed on Oct. 13, 2004, now abandoned.

(51) Int. Cl.
*A47C 27/00* (2006.01)

(52) U.S. Cl. ..... 5/699; 5/733; 5/486; 5/499

(58) Field of Classification Search ..... 5/486, 499, 5/699, 733
See application file for complete search history.

(56) References Cited

U.S. PATENT DOCUMENTS

| | | | | |
|---|---|---|---|---|
| 2,639,444 | A * | 5/1953 | De Monsabert | 5/699 |
| 2,659,421 | A * | 11/1953 | Wass et. al. | 5/657.5 |
| 3,121,886 | A * | 2/1964 | Seymour | 441/129 |
| 3,298,044 | A * | 1/1967 | Saltness et al. | 5/644 |
| 4,737,998 | A * | 4/1988 | Johnson, Sr. | 5/422 |
| 6,260,222 | B1 * | 7/2001 | Lin | 5/709 |
| 6,351,864 | B1 | 3/2002 | Karafa et al. | |
| 6,594,838 | B1 * | 7/2003 | Hollander et al. | 5/636 |
| 6,952,851 | B1 * | 10/2005 | Mahoney | 5/690 |
| 2005/0262642 | A1 * | 12/2005 | Miller | 5/737 |

FOREIGN PATENT DOCUMENTS

GB 772025 * 4/1957

* cited by examiner

*Primary Examiner* — Michael Trettel
(74) *Attorney, Agent, or Firm* — Cohen & Grigsby, P.C.

(57) ABSTRACT

A composite mattress with or without a pillow made of flexible or compressible filling material covered by a pliable transparent polymeric cover material with a visual clarity to allow one to detect, locate, and identify contraband items hidden under the cover material.

3 Claims, 1 Drawing Sheet

INSTITUTIONAL MATTRESS AND PILLOW COMPOSITE WITH TRANSPARENT COVERING

CROSS-REFERENCE TO RELATED APPLICATIONS

This is a continuation in part of application Ser. No. 10/964/483 filed on Oct. 13, 2004 now abandoned, entitled "A Confinement Facility Mattress Composite, a Pillow Composite and a Combination of a Mattress and Pillow Composite Each with a Pliable Transparent Polymeric Cover Material to Better Prevent Concealment of Contraband Items."

FIELD OF THE INVENTION

The present invention relates to a confinement facility mattress composite having an integrated pillow and more specifically to a composite mattress and pillow having a pliable transparent polymeric covering which does not compromise fire retardancy or comfort and is designed to prevent concealment of contraband items.

BACKGROUND OF THE INVENTION

This invention relates generally to mattresses, pillows and a combination of both. More particularly, to mattresses composed of a cover material which is generally flame retardant and has a flexible or compressible filling material with or without a pillow composite. See, e.g. U.S. Pat. No. 6,351,864. Bedding of this type is typically used in institutions such as hospitals, university or school dormitories and in penal or confinement facilities. For use in confinement facilities, this type of mattress does not prevent the concealment of contraband items for juvenile and adult detention facilities, prisons, jails, military brigs, and immigration detention facilities, hereinafter referred to as "confinement facilities".

It is estimated that over two million people are currently serving time in confinement facilities throughout the United States. This number is increasing rapidly and facilities are becoming more crowded. With this increase in population within confinement facilities, safety issues become more important. The use of contraband is a major security problem in the United States and throughout the world. The possession and use of such contraband may include weapons to kill or injure other inmates or correctional personnel, and to assist in escape from the confinement facilities. Often, these contraband items are concealed beneath the mattress or pillow covering materials. Current mattress and pillow covers used in confinement facilities are non-transparent and comprised of breathable fabric covering materials, fluid resistant colored vinyl materials, or other coated fabric materials, all providing ample opportunities to hide contraband items without the notice of security personnel. Such contraband is not easily or quickly detectable by security personnel and facility inspectors.

Accordingly, it is the objective of the present invention to provide improved and safer articles of bedding for confinement facilities and institutions which better prevent concealment of contraband and result in improvements in detection, location, and identification of contraband items. It is a further object of the present invention to provide a novel mattress composite comprised of a pliable transparent cover which is useful in institutions such as hospitals and dormitories, but is particularly useful in confinement facilities. It is yet another object of the invention to provide a composite mattress using a polymeric transparent material that is preferably pliable, UV resistant, anti-microbial, and flame retardant with fluid resistant or impermeable properties.

SUMMARY OF THE INVENTION

This invention provides a new composite mattress and pillow for confinement facilities and institutions. The mattress composite uses a pliable transparent polymeric cover material to help prevent concealment of contraband thus providing a more secure environment for inmates and correctional personnel. The composite of the mattress and pillow can be similar to that shown in U.S. Pat. No. 6,351,864, for example, or formed with a flame retardant molded foam. The mattress according to a preferred embodiment of the invention comprises a flexible or compressible filling core material and a pliable transparent polymeric cover material having a degree of clarity which permits visual inspection of the mattress to detect, locate, or identify any contraband items hidden therein. The flexible or compressible filling material for the mattress and pillow composite preferably provides both support and comfort for the human body during rest. Such materials include, but are not limited to flexible foam, cotton batting, polyester or other synthetic batting, and the like. Other advantages of the invention will become apparent from a perusal of the following detailed description of a presently preferred embodiment taken together with the accompanying drawing.

DETAILED DESCRIPTION OF THE INVENTION

Figure 1:
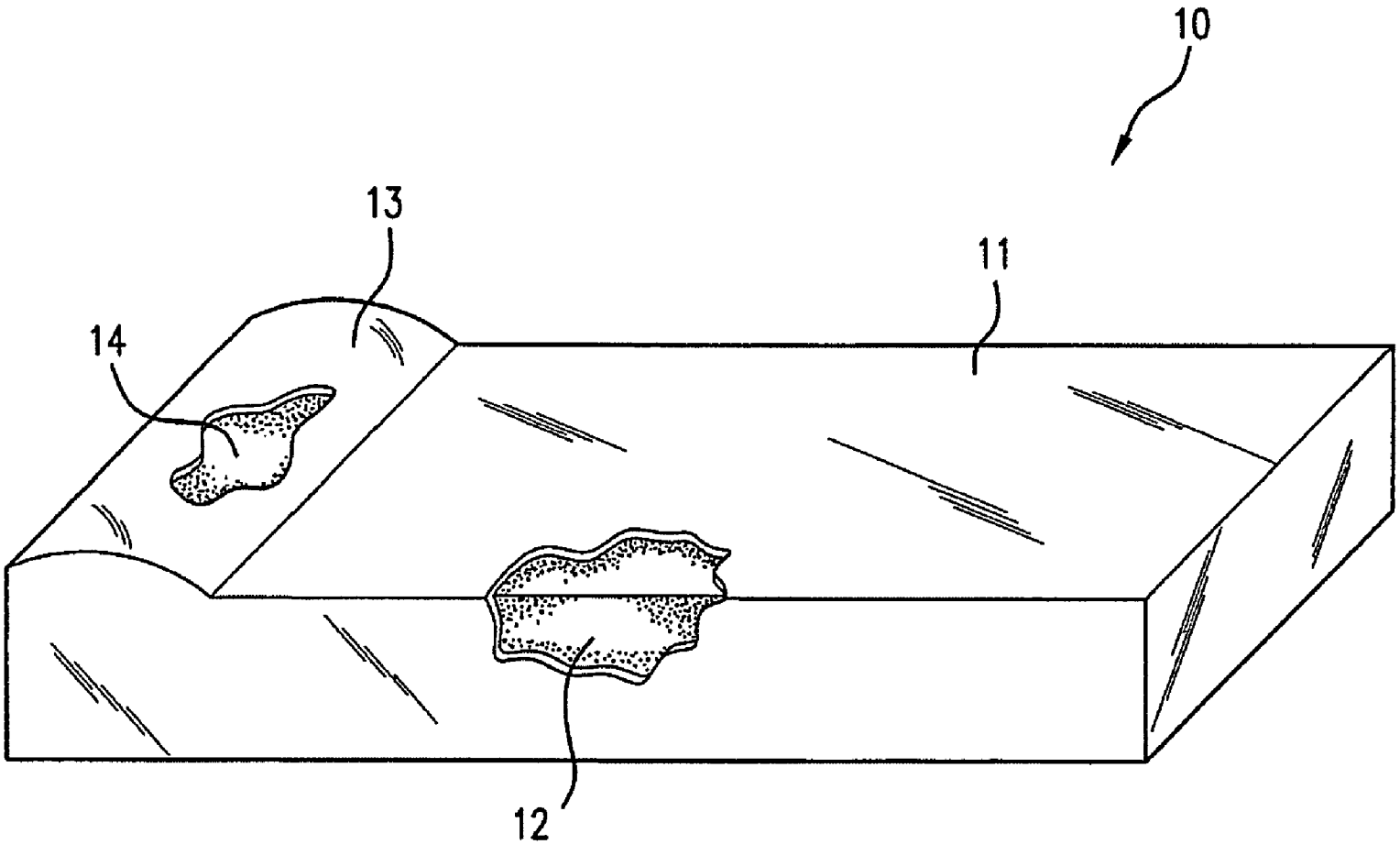
FIG. 1 is a perspective view of a mattress according to a preferred embodiment of the invention.

With respect to FIG. 1, a mattress 10 is shown comprising a pliable transparent polymeric cover material 11 have a degree of visual clarity, which permits visual inspection into the filling material 12 of the mattress 10 and pillow 13 comprising filling 14 which is preferably the same as material 12. Preferably filling material 12 comprises such materials including, but not limited to, flexible foam, cotton batting, polyester or other synthetic batting, and the like. These materials are antibacterial and flame retardant as is well known in the art. Also, the polymeric transparent cover material 11 protects the mattress and pillow and is itself fluid resistant, anti-microbial, UV resistant and flame-retardant as well as being pliable and transparent. In an example, the polymeric cover material comprises a transparent flame retardant vinyl polymer. Typically, the transparent material is a polymeric cover that encompasses the formed mattress. It is stitched or otherwise sealed along its edges in a manner similar to prior art mattress covers. One such cover material that is suitable for use in the invention is "ClearView™" cover material distributed by Spec-Tex Inc. This product provides good visibility into the mattress composite, passes the NFPA 701-1999 test for flame resistance and can be laminated, coated or extruded to a fabric.

The dimensions of the mattress composite and a combination of a mattress and a pillow composite can each be manufactured for any bunk dimensions, in addition to variations in thickness.

The present invention is to encapsulate the mattress filling material, pillow filling material and a combination of a mattress and a pillow filling material each with a pliable transparent polymeric cover material with a degree of clarity, to better prevent the concealment of contraband thus better safeguarding the confinement facilities environment. In an example, at least one pillow is positioned at one end of the mattress within the transparent polymeric cover material. In another example, two pillows are disposed on opposite sides of the filling material.

The present invention helps solve a longstanding major problem in confinement facilities.

Obviously, many modifications may be made without departing from the basic sprit of the present invention. Accordingly, it will be appreciated by those skilled in the art that within the scope of the appended claims, the invention may be practiced other than has been specifically described herein.

We claim:

1. A composite mattress for use in confinement facilities and institutions comprising:

a flexible, compressible polymeric foamed filling material, cotton, polyester or synthetic batting formed in the shape of a mattress, and a pliable transparent flame retardant polymeric cover encapsulating said filling material wherein said polymeric cover material is fluid resistant, anti-microbial and UV resistant and includes a nylon, polyester or similar open weave fabric support material, wherein said mattress is not inflatable.

2. The composite mattress of claim 1 wherein the pliable transparent polymeric cover material has a degree of clarity for permitting visual detection, location, and identification of contraband hidden under the cover.

3. The composite mattress of claim 1, including at least one pillow, wherein the pillow is positioned at one end of the mattress within the transparent polymeric cover material.

* * * * *